US008607579B2

(12) United States Patent
Williams et al.

(10) Patent No.: US 8,607,579 B2
(45) Date of Patent: Dec. 17, 2013

(54) PARTICLE-MEDIATED HEAT TRANSFER IN BERNOULLI HEAT PUMPS

(75) Inventors: Arthur R. Williams, Holden, MA (US); Charles Agosta, Harvard, MA (US)

(73) Assignee: Machflow Energy, Inc., Worcester, MA (US)

( * ) Notice: Subject to any disclaimer, the term of this patent is extended or adjusted under 35 U.S.C. 154(b) by 951 days.

(21) Appl. No.: 12/397,915

(22) Filed: Mar. 4, 2009

(65) Prior Publication Data

US 2009/0223650 A1 Sep. 10, 2009

Related U.S. Application Data

(60) Provisional application No. 61/068,093, filed on Mar. 4, 2008.

(51) Int. Cl.
*F25B 9/00* (2006.01)
*F25B 13/00* (2006.01)
*F25D 9/00* (2006.01)

(52) U.S. Cl.
USPC ..... 62/5; 62/86; 62/324.2; 62/401

(58) Field of Classification Search
USPC ..... 62/5, 86–87, 324.1–324.2, 401–402
See application file for complete search history.

(56) References Cited

U.S. PATENT DOCUMENTS

| | | | | |
|---|---|---|---|---|
| 2,325,036 A | | 7/1943 | Case | |
| 2,441,279 A | | 5/1948 | McCullum | |
| 3,049,891 A | | 8/1962 | Barkelew | |
| 3,200,607 A | | 8/1965 | Williams | |
| 4,028,906 A | * | 6/1977 | Gingold et al. | 62/183 |
| 4,134,709 A | * | 1/1979 | Eskesen | 416/1 |
| 4,378,681 A | * | 4/1983 | Modisette | 62/500 |
| 4,670,026 A | | 6/1987 | Hoenig | |
| 4,690,245 A | * | 9/1987 | Gregorich et al. | 181/272 |
| 5,056,593 A | | 10/1991 | Hull | |
| 5,222,309 A | * | 6/1993 | Ross | 34/632 |
| 5,431,346 A | * | 7/1995 | Sinaisky | 239/399 |
| 7,114,662 B1 | * | 10/2006 | Nikkanen | 239/2.2 |
| 2007/0039721 A1 | * | 2/2007 | Murray | 165/109.1 |

FOREIGN PATENT DOCUMENTS

| | | | |
|---|---|---|---|
| DE | 4103655 | * | 8/1992 |
| DE | 4106655 | * | 8/1992 |

OTHER PUBLICATIONS

Standard Density of Water, CRC Handbook of Chemistry and Physics, 92nd Edition, 2012.*
Thermophysical Properties of Air, CRC Handbook of Chemistry and Physics, 92nd Edition, 2012.*

* cited by examiner

*Primary Examiner* — Frantz Jules
*Assistant Examiner* — Henry Crenshaw
(74) *Attorney, Agent, or Firm* — Bingham McCutchen LLP

(57) ABSTRACT

Embodiments of a heat transfer apparatus, and related methods, involve at least one boundary wall defining a first flow path through a neck portion, a first heat source external to and in thermal communication with the boundary wall, and a working fluid (e.g., a first fluid component with a second fluid component entrained therein). The neck portion may be shaped such that at least a portion of the second fluid component impinges upon at least a portion of the boundary wall as the working fluid flows therethrough, whereby heat is transferred from the first heat source to the working fluid through the boundary wall.

46 Claims, 11 Drawing Sheets

PARTICLE-MEDIATED HEAT TRANSFER IN BERNOULLI HEAT PUMPS

CROSS-REFERENCE TO RELATED APPLICATIONS

This application claims priority to, and the benefit of, U.S. Provisional Patent Application No. 61/068,093, filed on Mar. 4, 2008, the entire disclosure of which is hereby incorporated by reference.

TECHNICAL FIELD

In various embodiments, the invention relates to heat transfer systems, and more particularly to systems and methods for the transfer of heat between a heat source and a fluid passing a boundary wall in thermal communication with the heat source.

BACKGROUND

Heat transfer systems such as heat pumps may be used to move heat from a source to a sink, and may underlie, for example, the operation of air-conditioning systems and/or heating systems for buildings.

Heat transfer systems can be divided into two fundamental classes distinguished by the direction in which heat moves. In one class of heat transfer system, heat flows from higher temperatures to lower temperatures. This heat flow may, for example, be harnessed to produce mechanical work, as in internal-combustion engines. A second class of heat transfer device includes systems that move heat from lower temperatures to higher temperatures. Such systems are commonly called "heat pumps." Refrigerators and air conditioners, for example, are heat pumps.

Heat pumps necessarily consume power. In general, commonly used heat pumps employ a working fluid (gaseous or liquid) whose temperature is varied over a range extending from below that of the source to above that of the sink to which heat is pumped. The temperature of the working fluid is often varied by compression of the fluid. While conventional heat pumps may be effective in transferring or pumping heat, substantial power (in the form of mechanical work) is necessary to compress the fluid and facilitate heat transfer, making these systems inefficient.

SUMMARY OF THE INVENTION

In various embodiments, the present invention relates to improved systems and methods for transferring heat between a heat source and a fluid. More particularly, embodiments of the invention include heat transfer systems, such as, but not limited to heat pumps, that utilize the "Bernoulli principle" to enable heat transfer between a heat source and a working fluid, whereby microscopic random molecular motion (temperature and pressure) is converted into directed motion (macroscopic fluid flow) while leaving the total kinetic energy unchanged. Whereas compression consumes power, Bernoulli conversion does not. The use of Bernoulli heat transfer, therefore, substantially improves system efficiency relative to conventional, compression-based systems.

One aspect of the invention relates to a heat transfer apparatus. In various embodiments, the apparatus includes at least one boundary wall defining a first flow path through a neck portion, a first heat source external to and in thermal communication with the boundary wall, and a working fluid. The working fluid includes a first fluid component with a second fluid component entrained therein. The neck portion is shaped such that at least a portion of the second fluid component impinges upon at least a portion of the boundary wall as the working fluid flows therethrough, whereby heat is transferred from the first heat source to the working fluid through the boundary wall.

In one embodiment, the boundary wall includes a first wall portion defining a venturi. The venturi may include a curved central axis or a substantially straight central axis. The boundary wall may include a second or downstream wall portion located within and/or downstream of an apex of the neck portion. The neck portion may have a diffuser section in which the downstream wall portion is located. The downstream wall portion may include a leading edge extending upstream towards the apex of the neck portion. In one embodiment, a portion of the downstream wall exhibits a high thermal conductivity.

The second fluid component may comprise a liquid and/or a vapor. The second fluid component may include, or consist essentially of, water. The second fluid component may change phase upon impingement with the boundary wall. In one embodiment, the first fluid component includes, or consists essentially of, air. In another embodiment, the first fluid component includes, or consists essentially of, one or more rare gases.

The apparatus may include a drive system for driving the working fluid through the neck portion. In one embodiment, the first heat source includes means defining a second flow path external to the boundary wall. The second flow path may be substantially perpendicular to the first flow path through the neck portion. In various implementations, the apparatus includes means defining a return flow path to transport a fluid passing from an exit of the neck portion back to an entrance of the neck portion. The first flow path and return flow path may define a closed loop. In one embodiment, the return flow path includes a heat exchanger, which may remove heat from the working fluid. Alternatively, the first flow path, i.e. the working fluid flow path, may comprise an open loop. The heat source may include one or more second flow paths in thermal communication with one or more sources of heat.

In one embodiment, the apparatus includes a fluid injection system upstream of the neck portion. The fluid injection system injects the second fluid component into the first fluid component.

Another aspect of the invention relates to a method of transferring heat. The method includes providing a flow path having a neck portion defined by at least one boundary wall, providing a first heat source external to and in thermal communication with the boundary wall, and driving a working fluid (which includes a first fluid component with a second fluid component entrained therein) through the neck portion such that at least a portion of the second fluid component impinges upon at least a portion of the boundary wall as the working fluid flows therethrough. As a result, heat is transferred from the first heat source to the first fluid component through the boundary wall.

The second fluid component may be denser than the first fluid component, or become denser due to condensation. The working fluid, prior to encountering the neck portion, may include a cold core radially surrounded by a boundary layer exhibiting a relatively low heat conduction, with at least a portion of the second fluid component in thermal equilibrium with the cold core. In one embodiment, when the working fluid encounters the neck portion, at least a portion of the second fluid in thermal equilibrium with the cold core passes through the boundary layer and out of thermal equilibrium to absorb heat from the first heat source.

In one embodiment, the boundary wall includes a first wall portion defining a venturi. The venturi may include a curved central axis, or a substantially straight central axis. The neck portion may include a wall portion located downstream of the apex of the neck portion. The downstream wall portion may be located within a diffuser section of the neck portion and/or downstream of the neck portion. In one embodiment, the downstream wall includes a leading edge extending upstream towards the apex of the neck portion. At least a portion of the downstream wall may exhibit a high thermal conductivity.

In various embodiments, the second fluid component includes a liquid and/or a vapor. For example, the second fluid component may include, or consist essentially of, water. In one embodiment, the second fluid component changes phase upon impingement with the boundary wall. The first fluid component may include, or consist essentially of, air, a rare gas, or a mixture thereof.

In various implementations, the first heat source includes a second flow path external to the boundary wall. The second flow path, i.e. the heat source flow path, may be substantially perpendicular to the first flow path through the neck portion. The method may further include transporting a fluid passing from an exit of the neck portion back to an entrance of the neck portion over a return flow path. The first flow path and the return flow path may define a closed loop, but alternatively, the first flow path may comprise an open loop.

In an exemplary implementation, heat is removed by a heat exchanger in thermal communication with the return flow path. The method may further include injecting the second fluid component into the first fluid component.

Another aspect of the invention includes a heat transfer apparatus including at least one boundary wall defining a curved flow path with a first heat source external to and in thermal communication with the boundary wall. The apparatus includes a working fluid comprising a first fluid component with a second fluid component entrained therein, wherein the curved flow path is shaped such that at least a portion of the second fluid component impinges upon at least a portion of the boundary wall as the working fluid flows therethrough, whereby heat is transferred from the first heat source to the working fluid through the boundary wall.

In one embodiment, the density of the second fluid component is larger than the density of the first fluid component. The second fluid component may include a plurality of particles having sufficient density that they do not follow the curvature of the first flow path when flowing therethrough, and rather pass through a boundary layer on an outer radial boundary wall of the curved flow path to impinge upon the boundary wall. The second fluid component may be in thermal equilibrium with a core flow portion of the first fluid component prior to entering the curved flow path, with the core portion having a lower temperature than the boundary layer of the working fluid through the curved flow path.

The apparatus may include a fluid injection system upstream of the curved flow path. This fluid injection system may, for example, inject the second fluid component into a core flow portion of the first fluid component. The temperature of a core section of the working fluid may be lower than a temperature of at least a portion of the boundary wall of the curved flow path as the working fluid passes along the curved flow path.

These and other objects, along with advantages and features of the present invention herein disclosed, will become more apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

In general, the present invention relates to heat transfer systems, and more particularly to Bernoulli heat pumps for use in transferring heat from a heat source to a working fluid.

Figure 1A:
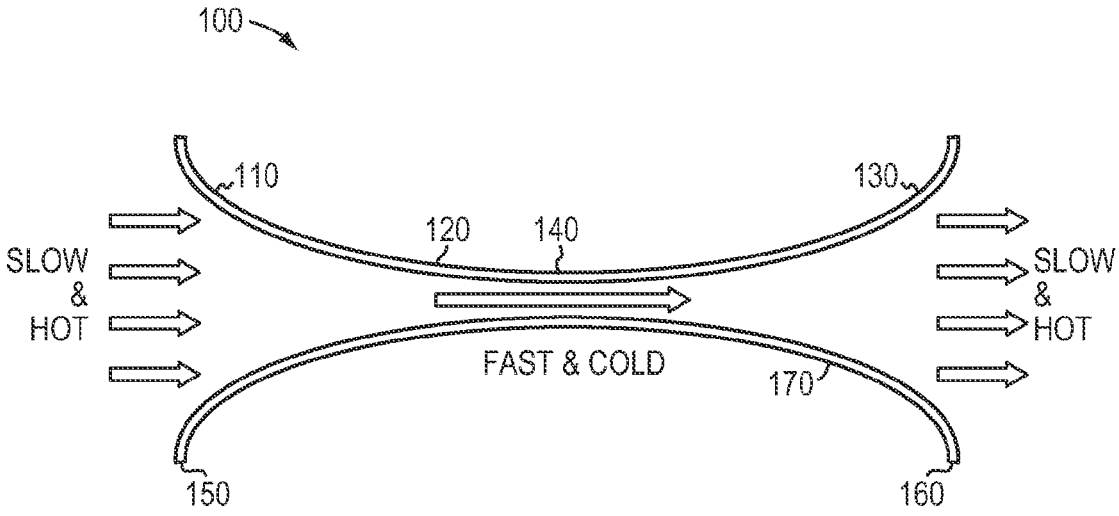
FIGS. 1A and 1B shows a schematic side view of a venturi shaped flow, in accordance with one embodiment of the invention.
Figure 1B:
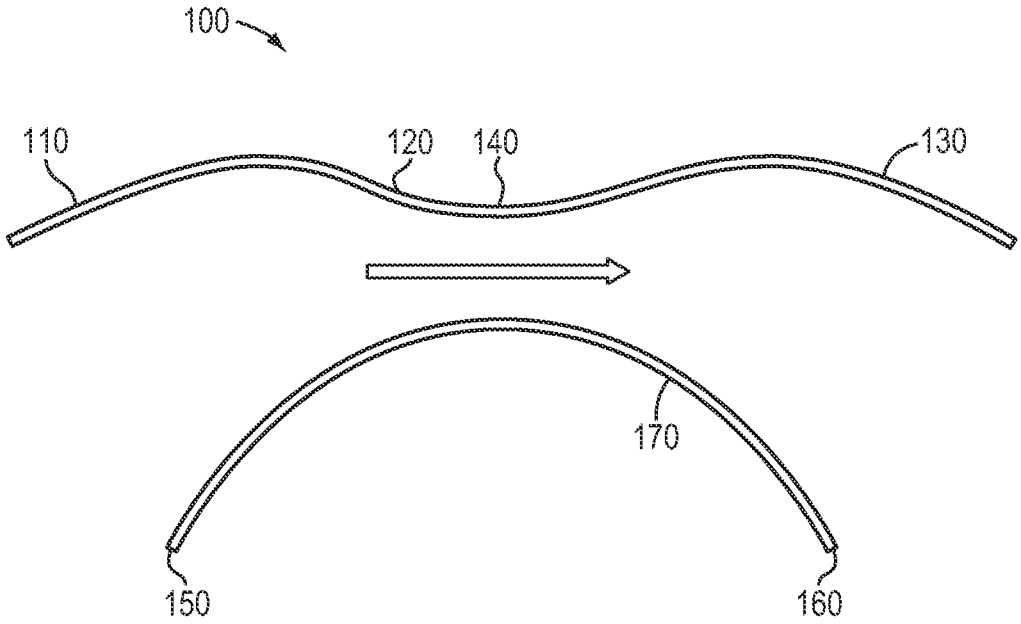

One embodiment of the invention includes a venturi-shaped channel through which a working fluid can flow in accordance with the Bernoulli principle. An exemplary venturi 100 is shown in FIGS. 1A and 1B. The venturi 100 includes an inlet portion 110, a neck portion 120, and a diffuser or outlet portion 130, with the cross-sectional area of the venturi 100 decreasing from the inlet portion 110 to the neck portion 120 and increasing, after passing an apex 140 of the neck portion 120, in the outlet portion 130. The venturi 100 may have any appropriate cross-sectional shape such as, but is not limited to, a circular, oval, square, or rectangular cross-section. The cross-sectional shape may be constant along the length of the venturi 100. Alternatively, depending on the application, the cross-sectional shape may vary along the length of the venturi 100. For example, the cross-section of the venturi 100 may be substantially circular at an apex 140 of the neck portion 120 while being substantially square at an outer edge 150 of the inlet portion 110 and/or an outer edge 160 of the outlet portion 130.

In operation, a working fluid enters the venturi 100 through the inlet portion 110. As the cross-sectional area of the venturi 100 decreases towards the neck portion 120, the directed motion of particles within the working fluid must increase in order to maintain a constant mass flux. Such conversion occurs, without the addition of energy, by the local reduction of the random molecular motion of the particles. As a result, as the cross-sectional area decreases, the temperature and pressure of the working fluid decrease, while the velocity of the working fluid increases. Whereas compression consumes power, Bernoulli conversion does not. Though Bernoulli conversion itself consumes no power, the fluid nozzling may result in relatively strong velocity gradients within the working-fluid flow, which may result in some viscous loss. After passing through the neck portion 120, the cross-sectional area of the venturi 100 increases, resulting in a reduction in fluid velocity and a corresponding increase in pressure and temperature.

Therefore, as the working fluid flows through the central neck portion 120 of the venturi 100, the velocity of the fluid increases while the temperature decreases. After the working fluid has passed the apex 140 of the central neck portion 120, the velocity of the working fluid decreases while the temperature increases. As a result, a venturi 100 may be used to quickly and efficiently reduce the temperature of a working fluid in the vicinity of the neck portion 120. Placing a heat source at or near the neck portion 120 allows the venturi 100 to act as a heat transfer system, with heat being passed from the heat source to the working fluid at the neck portion 120 as long as the temperature of the working fluid at the neck portion 120 is lower than that of the heat source (regardless of whether the temperature of the working fluid entering the inlet portion 110 is higher than that of the heat source). In various embodiments, the heat source is located within the neck portion 120, in the outlet portion 130 downstream of the neck portion 120, or extending between both the neck portion 120 and the outlet portion 130.

In one embodiment, the venturi 100 is operated by driving the working fluid through a flow path defined by at least one boundary wall 170. The boundary wall 170 may be formed from any appropriate material including, but not limited to, a metal, a ceramic, a plastic, or a composite material. In an alternative embodiment, the flow path including the venturi 100 may be self-forming, for example, by directing gas through a small aperture.

Figure 2:
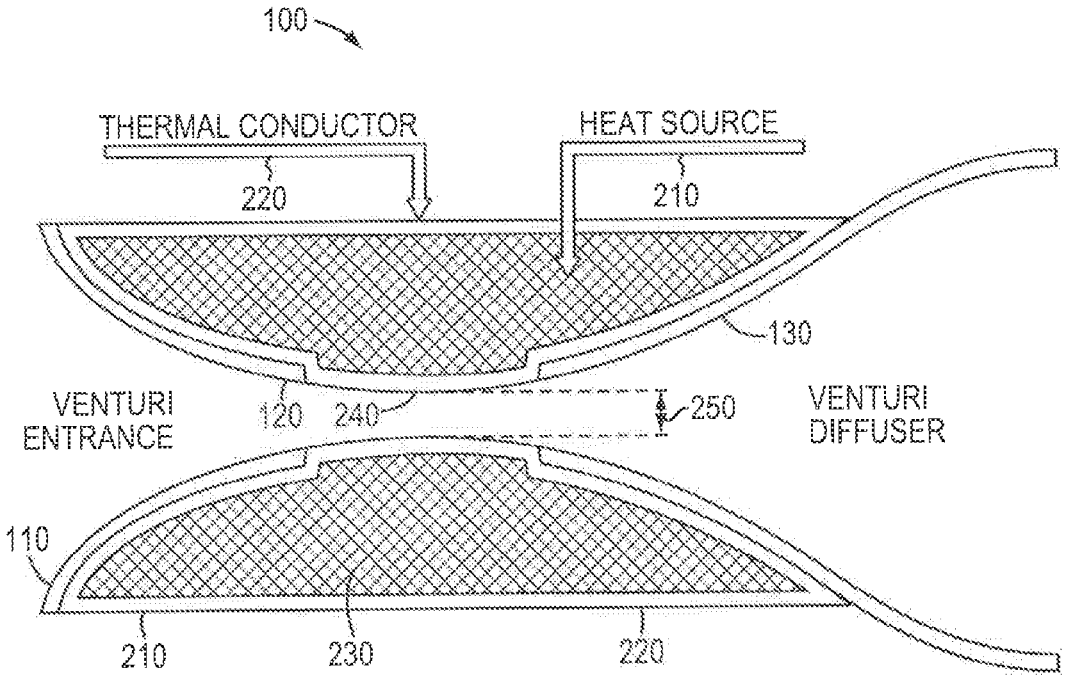
FIG. 2 shows a schematic side view of a heat transfer system including a venturi flow, in accordance with one embodiment of the invention.

An exemplary venturi 100 including a heat source in thermal communication with a neck portion 120 of the venturi 100 is shown in FIG. 2. In this embodiment, a working fluid is driven from an inlet portion 100, through the neck portion 120, and out through an outlet portion 130. A heat source 210 is positioned within the neck portion 120. The heat source 210 may be a source of air to be cooled, such as an interior air flow in a building, for an air conditioning system. Alternatively, the heat source may include a recirculating cooling fluid for a mechanical device, a pipe flow in a fluid transport system (such as, for example, an oil or gas piping system), a mixed-phase fluid flow, or any other appropriate fluid flow or solid heated material requiring cooling. Example heat sources may include components for electrical systems and/or vehicles, such as aircraft or ground transportation.

In the illustrated embodiment, the heat source 210 includes a channel 220 through which a heated fluid 230 is flowed. The channel 220 may include a material selected to provide a high thermal conductivity between the heat source 210 and the working fluid within the venturi 100. A high thermal conductivity material may include any material having a thermal conductivity that is higher than that of one or more surrounding materials in thermal communication with the high thermal conductivity material. Example materials include, but are not limited to, metals (such as, but not limited to, copper or aluminum), graphite-based materials, textured surfaces, including nano-textured surfaces, and/or carbon nano-tube based materials. In one embodiment, the channel 220 may include or consist essentially of a material such as, but not limited to, a metal such as copper, steel, aluminum, a ceramic, a composite material, or combinations thereof.

The channel 220 may be constructed from a single material or from a plurality of materials. For example, one embodiment of the invention includes a channel 220 having a high thermal conductivity in contact with the neck portion 120 of the venturi 100; elsewhere, the flow path has a lower thermal conductivity, or even a high thermal insulation.

In an alternative embodiment, the heat source 210 is a solid block of material, without a channel defined therethrough, such as, but not limited to, a metal such as copper, steel, aluminum, a ceramic, a composite material, or combinations thereof. The material is selected to provide a high thermal conductivity between the heat source 210 and the working fluid within the venturi 100. The solid block heat source 210 relies on conduction through the material to transport heat from a source to the neck portion 120 of the venturi 100.

In one embodiment, a portion 240 of the channel 220 is embedded within the boundary wall 170 of the venturi 100, such that the channel is in direct physical contact with the working fluid within a portion of the venturi 100, e.g., within the neck portion 120. In an alternative embodiment, the heat source 210 is placed against a sealed boundary wall 170 of the venturi 100, such that any heat transferred between the heat source 220 and the working fluid must pass through the boundary wall 170.

The heat source 210 may have any appropriate cross-sectional shape. For example, as shown in FIG. 2, the heat source 210 may conform to the boundary wall 170 of the venturi 100 along a portion thereof. Alternatively, the heat source 210 may have any desired cross-sectional shape such as, for example, a circular, oval, square, or rectangular cross-section.

In operation, heat is transferred from the heat source 210 to the working fluid as it passes through the neck portion 120 of the venturi 100 (i.e., the portion of the venturi 100 where the velocity is at a maximum and the temperature is at a minimum). Because convection is orders of magnitude more effective than conduction in transferring heat, the surface area of the channel portion 240 exposed to the working-fluid flow can be much smaller than that exposed to the heat-source flow. As a result, the entire channel 220 may be formed from a material exhibiting a high thermal conductivity (e.g., a metal), thereby allowing heat to be conducted from the heat source fluid 230 to the channel 220 over the entire cross-section of the channel 220, after which the heat is transferred from the channel 220 to the working fluid within the venturi 100 through the exposed channel portion 240.

Figure 3:
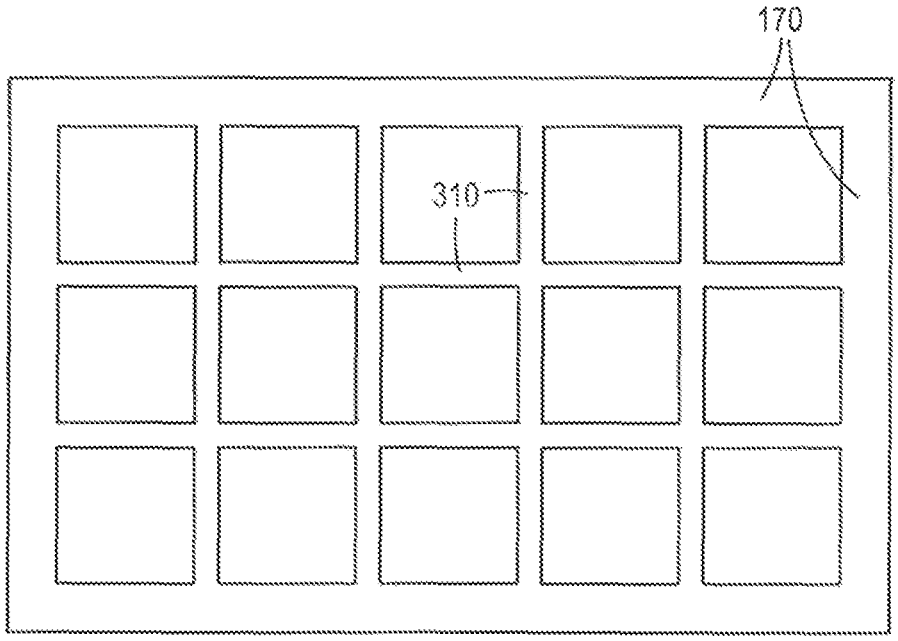
FIG. 3 shows a schematic front view of a grid structure for a heat transfer system including a venturi flow, in accordance with one embodiment of the invention.

One or more fins may extend from the channel portion 240 into either the working fluid within the venturi 100 and/or into the heat source fluid 230 to provide additional surface area over which heat transfer can take place. These fins may have any appropriate size and shape, and may be formed from any of the materials described herein. An exemplary fin structure for placement within the neck portion 120 of a venturi 100 is shown in FIG. 3. In this embodiment, fins 310 extend from the boundary wall 170 of the venturi 100 and are arranged in a grid pattern. The fins may, for example, be formed from the same material as the heat source channel 220 (in the case of a fluid flow based heat source) or of the same material as the heat source 210 itself (for a solid heat source). In one embodiment, the fins 310 extend from the exposed channel portion 240 at an apex 140 of the venturi 100. In alternative embodiments, any appropriate number, arrangement and placement of fins may be used. The fins may be hollow to allow the heated fluid 230 within the heat source channel 220 to flow through the fins.

The height 250 of the apex 140 of the neck portion 120 may be substantially smaller than the width of the cross-section at the apex 140, thereby allowing heat to be transferred between the heat source 210 and the working fluid within the venturi 100 over a substantial area.

In one embodiment, the venturi 100 is constructed as an open-loop system, such that the working fluid is entrained from the surrounding atmosphere and exhausted to the surrounding atmosphere after being driven through the venturi 100. In this embodiment, the working fluid may include, or consist essentially of, air. In another embodiment (for example, an implementation designed for underwater heat transfer), the working fluid may include, or consist essentially of, water, one or more rare gases, particles of one or more solid materials, or mixtures thereof. But more generally, any suitable gaseous or liquid working fluid may be utilized. The suitability of a working fluid may be determined by factors including, but not limited to, the thermal properties of the material, viscosity, toxicity, expense, and/or scarcity. In one embodiment, working fluids having lower values for specific heat are advantageous, at least because the specific heat determines how big a temperature drop is produced by a given flow speed. Suitable fluids include, but are not limited to, those having high thermal conductivity, low viscosity, appropriate gas-liquid transition temperatures (such as at or around the expected working temperature of the venturi 100), low cost (e.g. to manufacture and handle), and/or meeting required environmental standards. The working fluid may be driven through the venturi 100 by a fan, pump, blower, or other appropriate fluid drive system, placed either upstream of the venturi 100 (i.e. before the inlet portion 110) or downstream of the venturi 100 (i.e. after the outlet portion 130).

In an alternative embodiment, the venturi 100 is part of a closed-loop system wherein, upon exiting the outlet portion 130 of the venturi 100, the working fluid is recirculated back to the inlet portion 110. As the working fluid in a closed-loop system is not exhausted to the surrounding atmosphere, fluids which may be environmentally damaging, but which provide improved heat transfer characteristics over air, may be utilized. In order to remove the heat transferred to the working fluid from the heat source 210, one or more heat exchangers may be incorporated into a return leg of a closed-loop system.

Figure 4A:
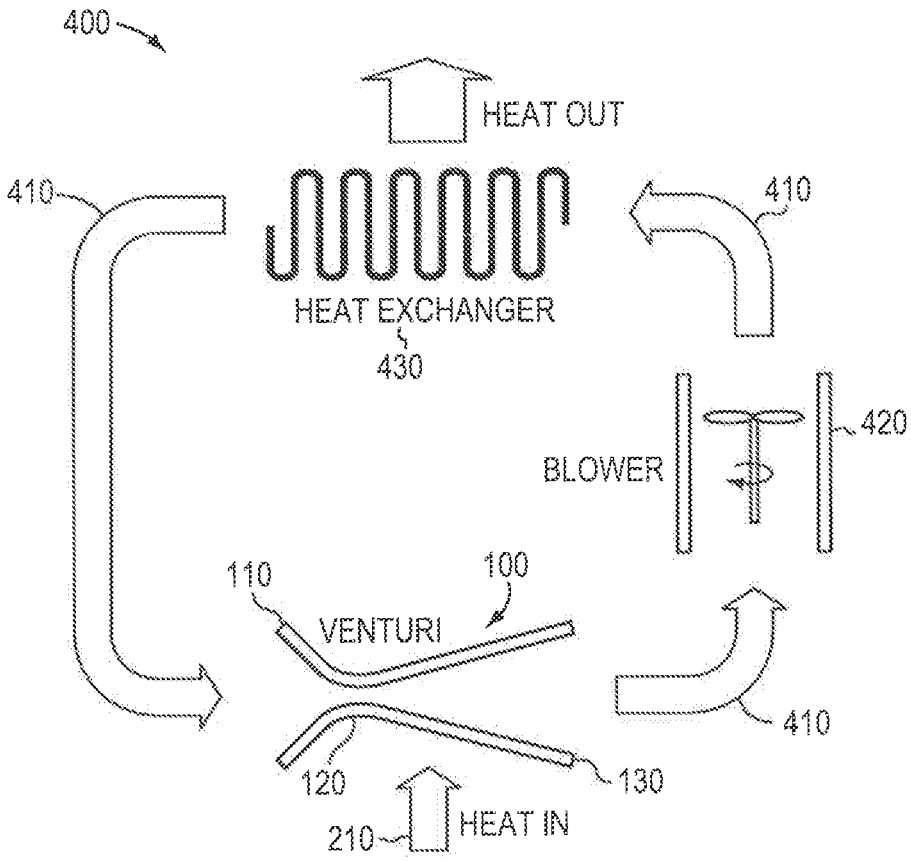
FIG. 4A shows a schematic view of a closed-loop heat transfer system including a venturi flow, in accordance with one embodiment of the invention.
Figure 4B:
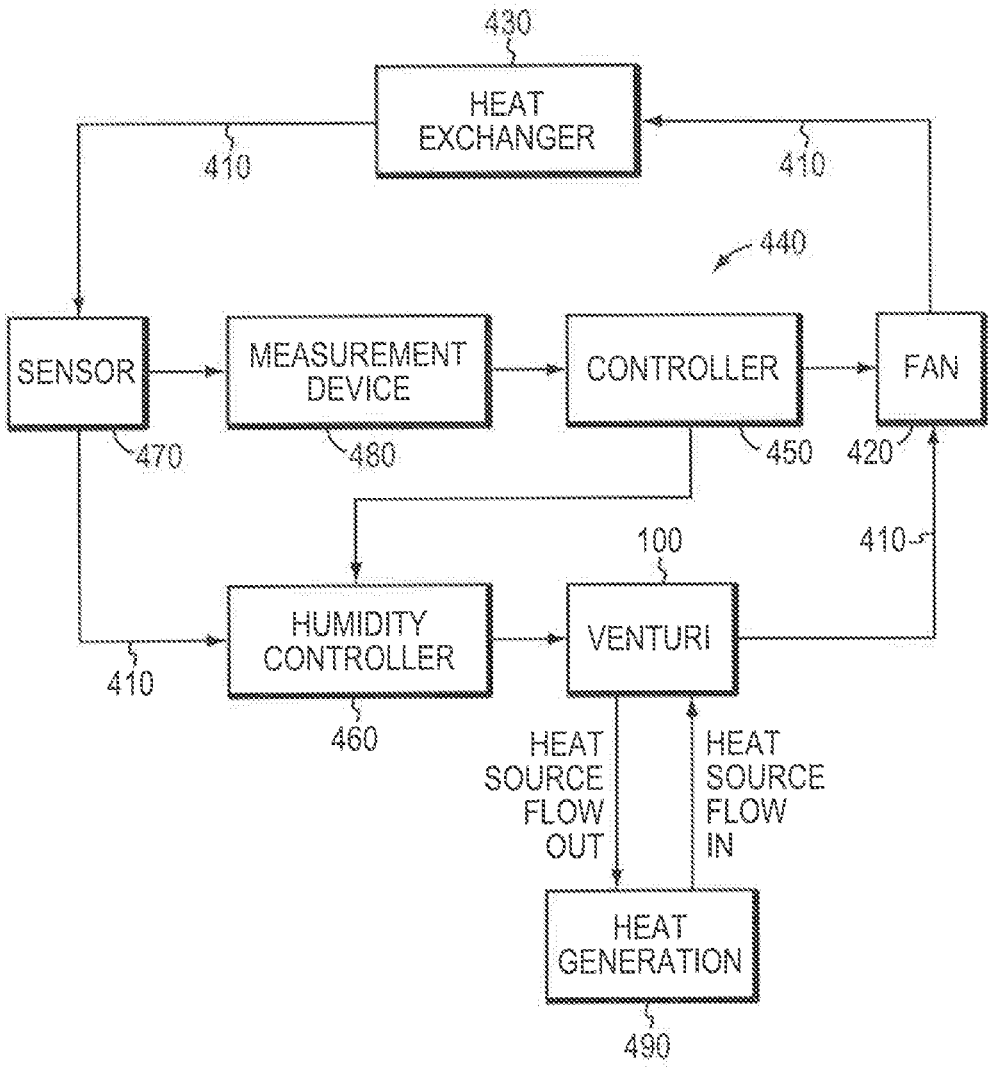
FIG. 4B shows a schematic view of the closed-loop heat transfer system of FIG. 4A, further including a control system.

FIG. 4B illustrates an exemplary closed-loop heat transfer system incorporating a return leg including a heat exchanger. In this embodiment, the heat transfer system 400 includes a venturi 100 through which a working fluid is driven, as described above. A heat source 210 is placed in thermal contact with the neck portion 120 of the venturi 100; heat is transferred from the heat source 210 to the working fluid as it is driven through the venturi 100. Upon exiting the outlet portion 130 of the venturi 100, a fluid return path 410 carries the working fluid back to the inlet portion 100 of the venturi 100. This fluid return path 310 may include, for example, a closed duct system through which the fluid is free to travel. One or more means of driving the working fluid around the fluid return path 410 and through the venturi 100 may be placed at any appropriate location within the system 400. For example, the embodiment shown in FIG. 4 includes a blower fan 420 located downstream of the venturi 100. More generally, any suitable fluid driving system may be used including, but not limited to, blowers, fans, pumps, turbines, and/or jets. Indeed, multiple fluid driving means—e.g., a plurality of blower fans 420 positioned at various locations around the closed fluid return flow path 410—may be used.

One or more heat exchangers 430 may be placed along the fluid return path 410 to remove the heat transferred to the working fluid from the heat source 210. The form of heat exchanger 430 is not critical to the present invention. Suitable configurations include, but are not limited to, parallel-flow heat exchangers, cross-flow heat exchangers, counter-flow heat exchangers, shell and tube heat exchangers, plate heat exchangers, regenerative heat exchangers, adiabatic wheel heat exchangers, plate fin heat exchangers, multi-phase heat exchangers, spiral heat exchangers, or combinations thereof. This heat exchanger 430 may, for example, take heat from the working fluid and vent it to the surrounding atmosphere.

The heat transfer system 430 may be used, for example, in an air-conditioning system, where heat is to be removed from the interior of a building and vented to the exterior of the building. In this embodiment, the heat source may include a flow of interior building air which is driven passed one or more venturis 100. Heat from the interior air is transferred to the working fluid, after which the interior air is exhausted back into the building. The heat that is transferred to the working fluid can then be removed from the working fluid by the heat exchanger 430, which vents the heat to the atmosphere outside the building. Alternatively, the heat from the working fluid may be utilized for other purposes, e.g., local or special-purpose heating, or power generation.

In alternative embodiments, heat transfer systems according to the invention include a plurality of venturis 100, heat sources 210, heat exchangers 430, and/or flow paths 410. Heat transfer systems according to the invention may also include both open-loop flow paths and closed-loop flow paths for either the working fluid and/or a heat source fluid flow.

In one embodiment, additional (and conventional) control devices are incorporated into the system to control elements of the working fluid flow including, but not limited to, the velocity, the pressure, the temperature, the humidity, and the volume and/or proportions of individual components of the working fluid. Measurement devices may also be incorporated into the system to monitor performance characteristics of the system including, but not limited to, the temperature, velocity, pressure, and properties and/or proportions of the individual components of the working fluid. In one embodiment, a control system receives data from the measurement device(s) and utilizes these to operate the control devices in order to optimize the performance of the system, continuously and in real-time. The control system may also respond to user inputs.

An exemplary heat transfer system 400 including a control system 440 is shown in FIG. 4B. The control system 440 includes a controller 450 (e.g., an electronic controller such as a computer, and/or a mechanical controller) that controls the functionality of a humidity controller 460 and/or a fan 420. The humidity controller 460 controls the injection of a second fluid component into the working fluid flow. The control system 440 also includes at least one sensor 470 for sensing at least one parameter of the working fluid flow (such as, but not limited to, temperature, flow rate, pressure, density, humidity, and/or chemical composition). The sensor(s) 470 may be place at any appropriate location within the heat transfer system 400 such as in the return flow path 410 upstream of the venturi 100. The sensor 470 is coupled to a measurement device 480 which communicates with the sensor 470 and sends a measured reading from the sensor 470 to the controller 450. In an alternative embodiment, the sensor 470 may communicate directly with the controller 450, without the need for a measurement device 480 therebetween. In operation, the control system 440 controls at least one parameter of the working fluid flow to assist in controlling the transfer of heat between the working fluid and the heat-source flow (from a heat-generation source 490 such as, for example, the interior air flow of a building).

In one embodiment, a pressure-control system may be used in a closed-loop system to control the pressure of the working fluid within the system. For example, a pressure-control system may pressurize the working fluid within the system to either above or below atmospheric pressure. In one embodiment, the working fluid is pressurized to a pressure of between 1.2 and 1.8 atmospheres, and more typically to a pressure of between 1.4 and 1.6 atmospheres. In an exemplary embodiment, the working fluid is pressurized to a pressure of approximately 1.5 atmospheres.

One embodiment of the invention includes a working fluid including a plurality of fluid components. In this embodiment, a heat transfer system incorporating a venturi can achieve a greater level of heat transfer than may be achieved using a single, unitary working fluid. In one embodiment, the working fluid includes two separate fluid components. In an alternative embodiment, three or more fluid components may be used.

Due to the effects of viscosity, the working fluid flowing through a venturi will include boundary-layer regions extending from the boundary walls of the venturi. More particularly, thermal equilibrium at the boundary wall implies the so-called "no-slip" boundary condition, wherein the mean velocity of the working fluid at the surface of the boundary wall is zero. The no-slip condition, in turn, implies a sharp variation of the macroscopic flow speed across (transverse to) the flow. The thin region in which this sharp variation occurs is called the boundary layer. Sharp speed variation causes the viscous generation of heat. The interplay among the viscous generation of heat, the conduction of heat by the slowly moving fluid near the boundary wall, and the convection of heat by the rapid axial flow away from the venturi wall determines the variation of the fluid temperature across the boundary layer.

This interplay may limit the transfer of heat into the working-fluid flow. The flow of heat between the boundary wall and the working fluid flow is affected by the transverse temperature gradient at the venturi wall. In particular, viscous heating causes the sign of this gradient to change as the wall temperature varies. As the wall temperature is reduced, a temperature is reached for which the transverse temperature gradient vanishes. Further reduction of the wall temperature results in heat transfer from the working fluid into the venturi wall. The temperature at which the transverse temperature gradient changes sign is called the adiabatic or recovery temperature. Temperature recovery across the boundary layer may, in some embodiments, limit the effectiveness of cooling based on the Bernoulli effect.

Figure 5:
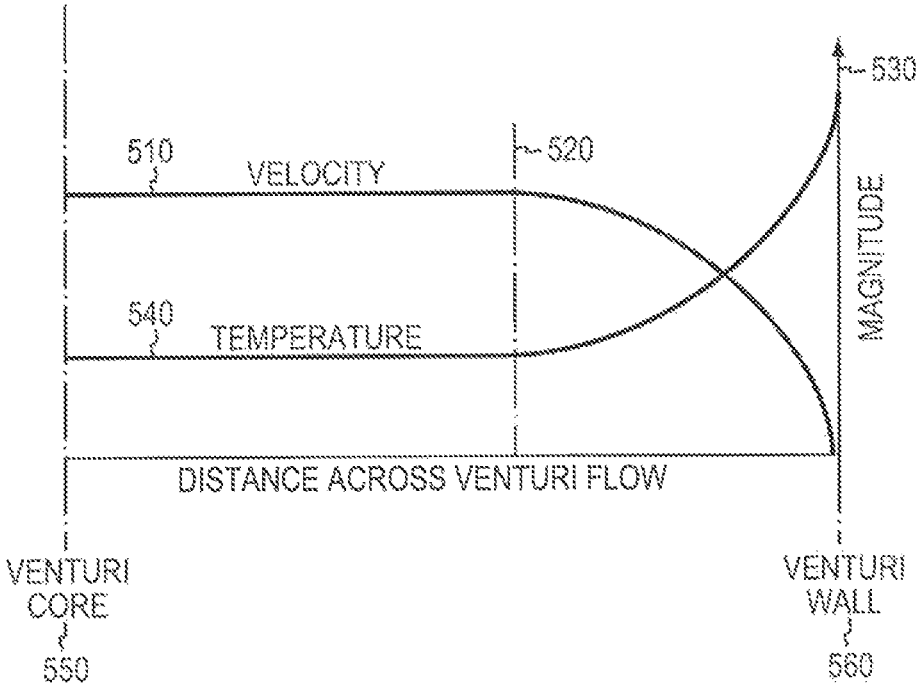
FIG. 5 is a graph showing the relationship between velocity and temperature across a width of a neck portion of a heat transfer system including a venturi flow, in accordance with one embodiment of the invention.

A graph showing the relative change in velocity and temperature of the working fluid near the boundary wall of a venturi is shown in FIG. 5. More particularly, the graph shows the magnitude 530 of the velocity 510 of the working fluid decreasing from its freestream value (in the venturi core 550 above the edge of the boundary layer 520) down to zero at the boundary wall 560 of the venturi. Simultaneously, the graph shows the temperature 540 of the working fluid increasing as it approaches the boundary wall 560 of the venturi.

By using a working fluid including a plurality of fluid components, the effect of the boundary layer on the transfer of heat from the heat source (in thermal communication with the boundary layer) to the working fluid may be substantially reduced. For example, in one embodiment of the invention, the working fluid includes a first fluid component including, or consisting essentially of, air. A second fluid component such as, but not limited to, water may be entrained into the fluid flow. Upon passing through the neck portion of a venturi, the second fluid component is separated from the mean flow path of the working fluid, passing through the boundary layer in the fluid near the wall, and impinging upon the surface of the boundary wall. When lower-temperature particles of the second fluid component impinge against the boundary wall, heat transfer therebetween increases.

The first and second working fluid components may be segregated within the venturi by any suitable means. More particularly, to achieve increased heat transfer, particles of a second fluid component—whatever their composition or thermodynamic state—after coming into thermal equilibrium with the working-fluid flow in the free-stream portion of the flow, are segregated from the first fluid component and impinge upon a boundary wall of the venturi. Segregating the first and second fluid may be accomplished by, for example, filtering, dehumidification and/or exhaust scrubbing.

In one embodiment, the particles of the second fluid component are segregated from the first fluid component through simple diffusion of the particles through the boundary layer. While diffusion may be relatively slow—thereby allowing the particles of the second fluid component to at least partially thermalize during passage through the boundary layer and, consequently, fail to deliver to the venturi wall a heat absorber characterized by the core temperature—the fact that the boundary layer is very thin, and the particles large, means that such thermalization is likely to be incomplete. As a result, diffusion of the particles of the second fluid component may still provide significant increases in heat transfer between the heat source and the working fluid.

In one embodiment, inertia is used to increase the flow of the particles of the second fluid component through the boundary layer to impinge upon a boundary wall. This concept may be utilized, for example, by guiding the working fluid around a corner, thereby subjecting the flow components to centrifugal force. The denser particles (i.e., the second fluid component particles) accumulate on the outside of the corner. If the corner has a thermally conducting wall shared by the working fluid and the heat source, then heat will be transferred from the heat source to the particle. To qualify as relative dense, the second fluid component, in one embodiment, is a liquid when it enters the curved flow path. The second fluid component may enter the flow upstream as either a gas or a liquid. For example, the second fluid component may be entrained into the working as a gas upstream of a venturi, and then condenses into a liquid as it enters the neck portion of the venture prior to entering the curved flow path section.

Alternatively, electrostatic segregation techniques may be used to assist in segregating particles of the second working fluid component from the first working fluid component. Exemplary methods of segregating particles entrained in a flow are described in U.S. Pat. Nos. 5,056,593 and 4,670,026, the disclosures of which are incorporated herein by reference in their entirety.

In one embodiment, a desiccant (i.e., a hygroscopic substance that induces or sustains a state of dryness (desiccation) in its local vicinity) may be used to attract, capture and release droplets of water within the working fluid flow. Alternatively or in addition, one or more gyrowheels (i.e., structures that permit the surface of a spinning disk to be cyclically exposed the working fluid) may be located with one portion within the neck portion of a venturi and another portion exposed to a heated fluid flow, such that heat is transferred through convection and conduction through the gyrowheel from the heated flow to the working fluid. Other methods of separating particles of the second fluid component from the first fluid component, such as ultrasound, may also be used to advantage.

The second fluid component may include particles of a solid, a liquid, a vapor, and/or a gas. For example, one embodiment of the invention uses water in a solid state (i.e., ice), in a liquid state, or as a vapor for the second fluid component. In alternative embodiments, other fluids including, but not limited to, helium (He), xenon (Xe), alcohol, ammonia, or mixtures thereof may be used for the second fluid component. The second fluid may also include, or consist essentially of, particles of a solid material such as, but not limited to, aluminum or carbon. Using a liquid for the second fluid component may be advantageous in that the ability of liquid particles to wet the thermally conducting wall in thermal contact with the heat source may increase the thermal conductivity between the heat source and the working fluid. Liquid particles also offer the possibility of exploiting thermodynamic phase changes by the Bernoulli heat pump. The addition of one or more second fluid components to the working fluid may increase the heat capacity of the working fluid.

One embodiment of the invention utilizes centrifugal force to segregate particle mixtures according to mass. In this embodiment, the working fluid may include a gas including first and second fluid components having particles of different mass, such as He and Xe. Forcing the high-speed flow in the neck portion around a corner (e.g., by means of a duct) creates a gradient in the relative concentrations of light and heavy particles without appreciably changing the temperature of the flow in the neck portion. In this way, the lighter species and the relatively high thermal conductivity they provide are concentrated near the inner wall of the corner. The inner wall of the curved section may therefore be used as a shared-wall heat exchanger.

Conceptually, the result is heat transfer into to a channel flow having a cold core (i.e. a core having a temperature lower than that of the heat source) separated from the channel wall by a poorly conducting boundary layer. Relatively dense particles of the second fluid component come to thermal equilibrium with (i.e., reach the same temperature as) the cold core of the first fluid component, and subsequently (downstream), because of their relative density, fail to negotiate a turn in the flow, and encounter a surface where heat transfer takes place. For example, the second fluid component, or a portion thereof, may change phase upon contact with the boundary wall. As a result, condensate droplets of the second fluid component transfer heat during a liquid-gas transition as they impinge upon the boundary wall. The latent heat of the liquid-gas transition during this boiling process is relatively large, thereby producing an effective means of transferring heart from the boundary wall (in thermal communication with the heat source) to the working fluid. The decrease in the density of condensate particles of the second fluid component due to a phase change on the boundary wall shared by the working-fluid and heat-source flows may be restored, for example in the inlet portion of the venturi in a closed-loop system.

A measure of the potency of a gas-liquid phase transition for heat transfer is the ratio of the latent heat of vaporization to the specific heat. For air, the specific heat is approximately 1, whereas the latent heat for the boiling of water is approximately 2200, in the same units. Thus, boiling even a small fraction of a modest density of water condensate particles may provide an effective heat-transfer mechanism.

Alternatively, particles of the second fluid component may impinge upon the boundary wall without changing phase, or with only partial phase change. Even if the liquid droplets of the second fluid component do not undergo a phase change on contact with the portion of the boundary wall of the venturi warmed by the heat source, the heat capacity of a droplet is, in general, greater than that of the carrier gas, and its greater mass means that the density-based segregation techniques discussed above can be used to bring cold droplets into direct thermal contact with the boundary wall, thereby increasing the transfer of heat between the boundary wall and the working fluid.

Figure 6:
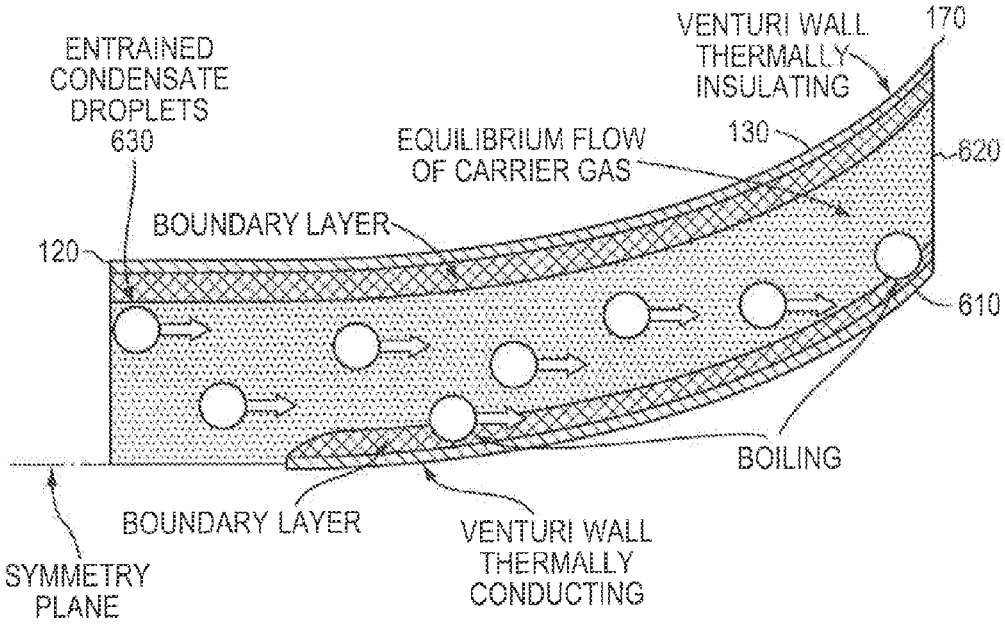
FIG. 6 is a schematic side view showing particle motion through a curved section of a heat transfer system including a venturi flow, in accordance with one embodiment of the invention.

FIG. 6 shows the impingement of particles of a second fluid component on an outer radial boundary wall of a curved flow path such as, but not limited to, a downstream boundary wall of a venturi. In this embodiment, the downstream boundary wall portion 610 is positioned immediately downstream of the neck portion 120 of a venturi 100. The downstream boundary wall portion 610, in conjunction with the boundary wall 170 in the outlet portion 130, forces the mean working fluid flow to follow a curved trajectory. Lighter particles 620 (i.e., particles of the first fluid component) readily follow this curved trajectory, while heavier particles 630 (i.e., particles of the second fluid component) do not. A phase change may occur when the condensate particles 630 of the second fluid component come into thermal contact with the downstream boundary wall portion. Alternatively, no phase-change takes place, but even without a phase change, the relatively heavy particles 630 of the second fluid component deliver the thermal properties of the flow core to the heat-exchanger wall, thereby encouraging enhanced heat transfer between the downstream boundary wall portion 610 and the working fluid. For example, a phase change at the downstream boundary wall portion 610 may not be necessary for a condensate particle 630 of the second fluid to contribute significantly to heat transfer between the downstream boundary wall portion 610 and the working fluid—e.g., because the condensate particles 630 are relatively heavy and have a relatively high velocity, thereby allowing them to penetrate the boundary layer and deliver the thermal properties of the core of the working fluid flow directly to the downstream boundary wall portion 610.

The probability that a condensate particle 630 of the second fluid component (e.g. a liquid, such as water, droplet) will boil when it hits the downstream boundary wall portion 610 depends on the partial pressure of the liquid and the vapor concentration of the droplet material in the working fluid. Closed systems permit the use of materials with boiling points nearer room temperature. In one embodiment, one or more commonly used refrigerants having boiling points nearer room temperature and high partial pressures are used as the second fluid component. Exemplary refrigerants include R11 (which has a boiling point of approximately 24° C.), R22, or R401.

In one embodiment, the working fluid includes, or consists essentially of, a condensing fluid. Exemplary condensing fluids include He or He—Ar mixtures. While the liquid-gas phase transition is, in principle, available in all materials, its availability in humid air is of use in Bernoulli cooling, as it enables an open Bernoulli heat pump. An open Bernoulli heat pump can exploit several of the segregation techniques mentioned herein, such as inertial and electrostatic segregation techniques. The use of humid air as the working fluid may be advantageous, for example, as the adiabatic or restoration temperature of air eliminates most of the temperature drop provided by the Bernoulli effect. In humid-air-based systems, the Bernoulli effect may also lower the temperature in the core of the venturi flow sufficiently to keep the core temperature below the dew point, which may assist in the creation of liquid droplets. In addition, the humidity of an air-based working fluid is readily amenable to control. Thus, the dew point of the core flow in the neck portion can be kept above the core temperature.

While the temperature of the working fluid in the neck portion is kept below the dew point, the temperature outside the neck portion may be above the dew point. In that case, the condensate particles will form in the converging portion of the venturi, as the temperature descends. Condensation of water vapor may be accelerated by the availability of nucleation centers, such as dirt or other impurities. As the common occurrence of fog indicates, ambient air usually supplies a sufficient density of nucleation centers. Just as with the humidity, nucleation centers may be readily supplied as part of humidity control.

Particles within the working-fluid flow may be created by phase transitions driven by Bernoulli cooling. Liquid or solid particles formed by condensation are formed from gas particles already moving at the flow speed, as flow constituents. Condensate particles therefore move at flow speed and equilibrate thermally with the flow.

In one embodiment, water vapor is added as a second fluid component of the working fluid. In alternative embodiments, other gases or liquids may be used for the second fluid component. In the case of water, a second phase transition, that from liquid to solid, may also be utilized. In one embodiment, liquid particles are injected or entrained into the flow as the second flow component. After such injection or entrainment, the particles equilibrate thermally with the flow, and are thus able to pick up and carry downstream temperatures characteristic of the coldest portion of the venturi core flow.

The working fluid may, in some embodiments, consist of a single gaseous fluid component, which falls below its critical condensation point due to the decreasing temperature in the neck portion and if its partial pressure is exceeded in the fluid. An exemplary single-component system may utilize helium in a cryogenic environment below 5.2 K.

The working fluid flowing through the curved flow path may include a cold core flow portion with a boundary layer surrounding the cold core portion and having a temperature that increases towards the boundary wall of the curved flow path. The curved flow path may be defined by a fluid flow including, but not limited to a Bernoulli flow path, a venturi, a neck portion of a fluid channel, and/or a simple curved fluid flow channel.

This boundary layer may conduct heat relatively poorly between the boundary wall of the curved flow path and the central core flow portion of the working fluid. The working fluid includes a first fluid component with a second fluid component entrained therein, with the second fluid component in thermal equilibrium with the first fluid component within the cold core flow portion upstream of the curved flow path. The second fluid component may, for example, include a plurality of particles of a fluid having a greater density than that of the first fluid component.

In operation, the relatively dense particles of the second fluid component may be injected into the working fluid and come into thermal equilibrium with (i.e., reach substantially the same temperature as) the cold core of the working fluid upstream of the curved flow path. When the working fluid, including the particles of the second fluid component, flows through the curved flow path, the particles of the second fluid component are unable, due to their relative density, to follow the curvature of the flow. As a result, the particles of the second fluid component travel through the boundary layer on the surface of the outer radial wall of the curved flow path and impinge on the surface of that boundary wall. Due to the velocity and/or the thermal properties of the second fluid component, the particles of the second fluid impinging upon the boundary wall of the curved flow path are not in thermal equilibrium with the boundary wall and surrounding boundary layer, but are rather at a lower temperature than the boundary wall. As a result, heat is transferred from the boundary wall to the impinging fluid particles.

As a result, the flow of the two component working fluid through a curved flow path provides an out-of-equilibrium heat-transfer mechanism wherein relatively dense particles of a second fluid component, having equilibrated with the cold core, pass through the boundary layer out of equilibrium, as the relatively dense particles of the second fluid component pass through the boundary layer too quickly to thermally equilibrate with the working fluid in the boundary layer. The particles of the second fluid component effectively deliver the cold temperature of the core flow portion directly to the boundary wall of the curved flow path. In one embodiment, the relative density of the particles of the second fluid component results from condensation. In addition, the dense particles may change phase from a liquid to a gas (i.e., boil), or from a solid to a liquid (i.e., melt), as part of their collision with the boundary wall of the curved flow path.

Figure 7:
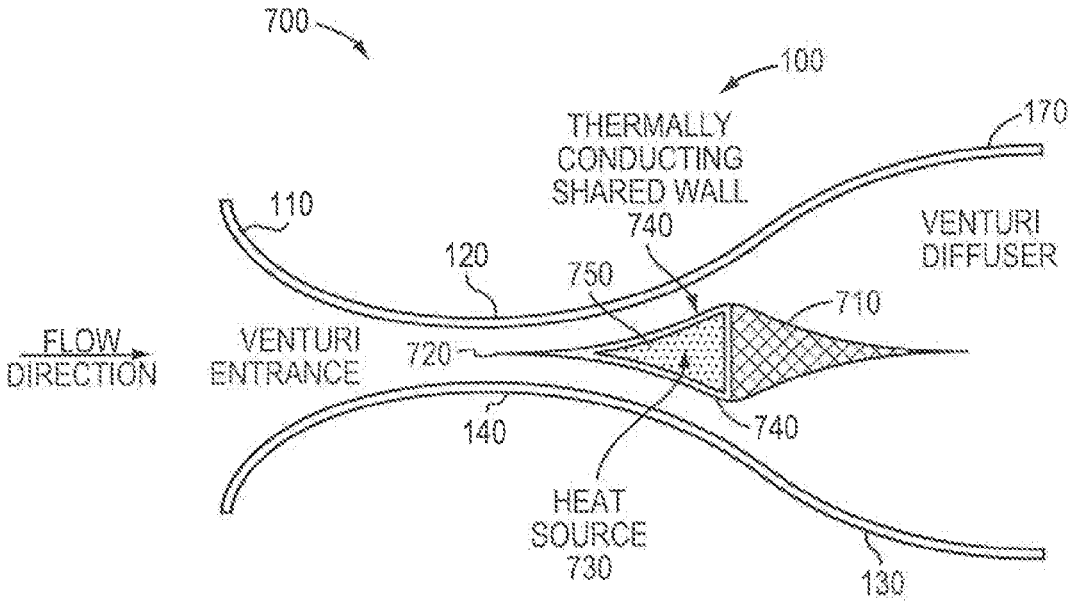
FIG. 7 shows a schematic side view of another heat transfer system including a venturi flow, in accordance with one embodiment of the invention.

Another exemplary heat transfer system 700 is shown in FIG. 7. In this embodiment, the heat transfer system 700 includes a venturi 100 having an inlet portion 110, a neck portion 120, and an outlet portion 130, with the cross-sectional area of the venturi 100 decreasing from the inlet portion 110 to the neck portion 120 and increasing after passing an apex 140 of the neck portion 120 to the outlet portion 130, as described hereinabove. Alternative embodiments of the heat transfer system 700 include other curved flow paths defined by at least one boundary wall in place of, or in addition to, the venturi 100. The heat transfer system 700 may also include a downstream boundary wall portion 710. The downstream boundary wall portion 710 is positioned in the outlet portion 130 of the venturi 100, with a leading edge 720 extending substantially to the apex 140 of the venturi 100. As a result, as the working fluid is driven through the venturi 100, it is forced to follow curved flow trajectories extending between the interior boundary wall portion 710 and the surrounding boundary wall 170 in the outlet portion 130. In an alternative embodiment, the leading edge 720 extends upstream (i.e., towards the inlet portion 110) into the neck portion 120, but does not extend as far upstream as the apex 140 of the venturi 100.

The downstream, interior boundary wall portion 710 may include a heat source 730. This heat source 730 may be a solid heat source and/or a fluid heat source (i.e., a gaseous and/or liquid-based heat source). In one embodiment, the heat source 730 includes a channel 740 through which a heated fluid 750 is driven. In one embodiment, the channel 740 defines at least a portion of the downstream boundary wall portion 710, and may be formed from any suitable material such as, but not limited to, a metal, a ceramic, a plastic, or a composite material, as described herein. In one embodiment, the channel 740 may be formed from a material that exhibits a relatively high thermal conductivity such as, but not limited to, metals (such as, but not limited to, copper or aluminum), graphite-based materials, textured surfaces, including nano-textured surfaces, and/or carbon nano-tube based materials. In an alternative embodiment, the channel 740 may be inserted within, and in thermal communication with, a separate material defining the downstream boundary wall portion 710.

The heat source 730 may be located in only a portion of the downstream boundary wall portion 710, such as, for example, the front half of the wall portion 710 (i.e., the part of the boundary wall portion 710 facing upstream towards the neck portion 120). Alternatively, the heat source 730 may define the entire downstream boundary wall portion 710. In a further alternative, the heat source 730 may be located within any appropriate portion of the downstream boundary wall portion 710.

The downstream boundary wall portion 710, with the heat source 730 embedded therein, may extend over the entire width of the venturi 100. In this configuration, the heated fluid 750 flows across the entire width of the venturi 100, thereby maximizing the area over which heat transfer may occur. In an alternative embodiment, the downstream boundary wall portion 710, and/or the heat source 730, extends over only a portion of the width if the venturi 100.

Depending on the application, the system 700 may include a plurality of downstream boundary wall portions 710, with heat sources 730 embedded therein, located within the outlet portion 130 of the venturi 100. Similarly, the system may include a plurality of venturis 100.

The working fluid being driven through the venturi 100 may include at least two fluid components. In operation, as the working fluid passes the apex 140 of the venturi 100, it follows a curved trajectory defined by the downstream boundary wall portion 710 and the boundary wall 170. As a result, particles of the second fluid component impinge on the surface of channel 740 and enhance the heat transfer between the heat source 730 and the working fluid, as described above. The second fluid component may, but need not, change phase upon impinging against the channel 740.

The heat transfer system 700 may be a closed-loop system, with one or more heat exchangers positioned within the return leg of the system to remove heat transferred to the working fluid from the heat source 730. Alternatively, the heat transfer system 700 may have an open-loop configuration, with the working fluid being vented to the surrounding atmosphere after passing through the venturi 100. The working fluid may be humid air, with air serving as the first fluid component and entrained particles of water as the second fluid component. In operation, at least a portion of the water droplets change phase upon impinging on the channel 740 of the heat source 730.

Figure 8:
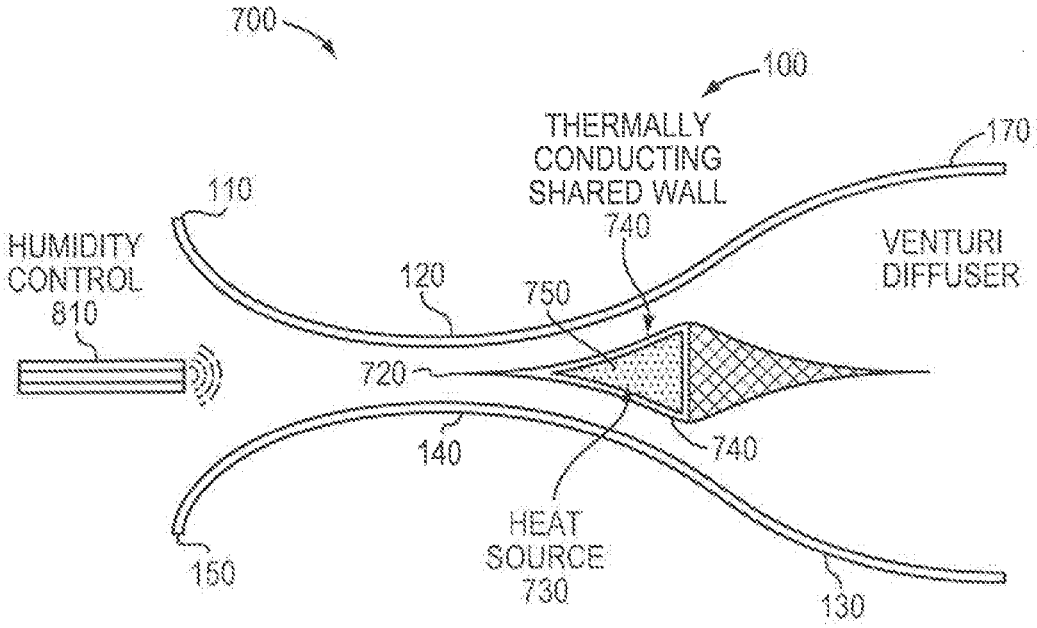
FIG. 8 shows the heat transfer system of FIG. 7, further including a humidity control apparatus.

A fluid control system may be located within the system 700 to control the entrainment of the second fluid component within the working fluid. An exemplary heat transfer system 700 including a fluid control system 810 is shown in FIG. 8. The fluid control system 810 includes a humification device (such as, but not limited to, a fluid injection device, a fluid removal device, a temperature control device, and/or a fluid flow rate control device) for controlling the humidity of the working fluid by, for example, injecting water particles (which act as the second fluid component) into the working fluid at a controlled rate. In an open-loop system, the fluid control system 810 is located at, or upstream of, the outer edge 150 of the inlet portion 110. In a closed-loop system, the fluid control system 810 may be located anywhere along the closed flow path of the working fluid.

As noted, the fluid control system 810 includes a device for injecting a fluid, such as water, into the working fluid. More generally, however, the fluid control system 810 may inject any appropriate fluid and/or solid to act as the second fluid component. Depending on the application, a plurality of fluid control systems 810 may be incorporated into the system 700, with each of these control systems injecting different fluids, or the same fluid, into the working fluid.

Figure 9:
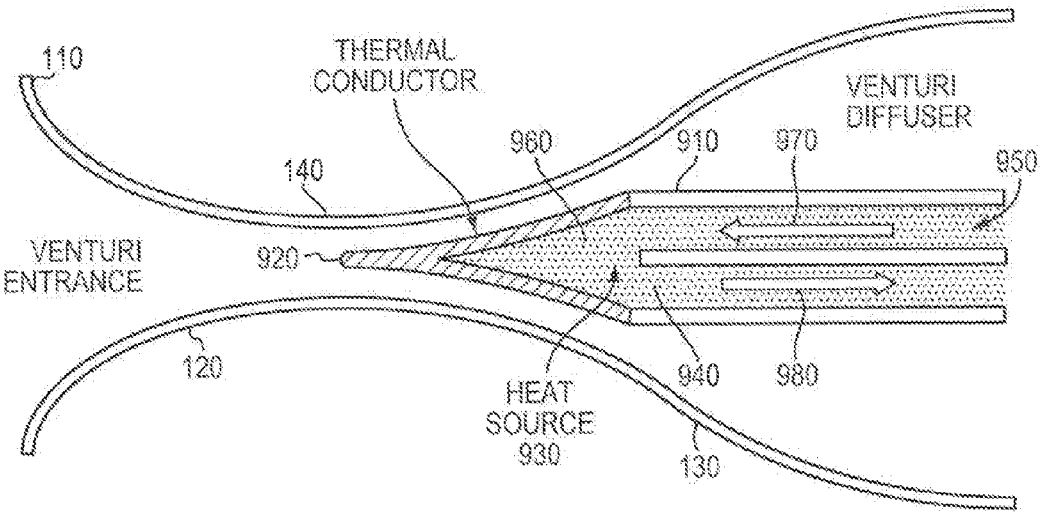
FIG. 9 shows a schematic side view of another heat transfer system including a venturi flow, in accordance with one embodiment of the invention.

Another exemplary heat transfer system 900 is shown in FIG. 9. The heat transfer system 900 includes a venturi 100 having an inlet portion 110, a neck portion 120, and an outlet portion 130, with a cross-sectional area of the venturi 100 decreasing from the inlet portion 110 to the neck portion 120 and increasing after passing an apex 140 of the neck portion 120 to the outlet portion 130, as described hereinabove. The heat transfer system 900 also includes a downstream boundary wall portion 910. The cross-section of the venturi 100 may be substantially circular or have any of the alternative forms described herein.

In this embodiment, the downstream boundary wall portion 910 is positioned in the outlet portion 130 of the venturi 100, with a leading edge 920 extending substantially to the apex 140 of the venturi 100. As a result, as the working fluid is driven through the venturi 100, it is forced to follow curved flow trajectories extending between the downstream boundary wall portion 910 and the boundary wall 170 in the outlet portion 130.

The downstream boundary wall portion 910 includes a heat source 930, which may be a solid heat source and/or a fluid heat source. The illustrated heat source 930 includes a flow path 940 through which a heated fluid 950 is driven. A distal portion 960 of the flow path 940 defines at least a portion of the downstream boundary wall portion 710, and may be formed from any appropriate material such as, but not limited to, a metal, a ceramic, a plastic, or a composite material, as described herein. Suitable materials include, but are not limited to, those having high thermal conductivity, high strength and durability, high chemical stability to all materials passing therethrough, low cost (e.g. to manufacture and handle), and/or meeting required environmental standards.

In one embodiment, wherein the venturi 100 has a substantially circular cross-section, the downstream boundary wall portion 910 may also have a substantially circular cross-section, with the distal portion 760 of the flow path 940 tapering down to a point at the apex 140 of the venturi 100. In operation, the heated fluid 950 flows along an entrance flow path 970 within the downstream boundary wall portion 910 towards the distal portion 760 of the flow path 940. Heat is transferred between the heated fluid 950 and the working fluid in the venturi 100 through the distal portion 760, as described hereinabove. The fluid 950 then returns down the downstream boundary wall portion 910 along an exit flow path 970. The heated fluid may include or consist essentially of air, water, or any other appropriate fluid component(s). Again, the venturi 100, and the downstream boundary wall portion 910 located therein, may have any suitable (e.g., rectangular) cross-sectional configuration.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A heat transfer apparatus, comprising:

at least one boundary wall defining a first flow path through a neck portion;

at least one downstream wall, located in an outlet portion of the heat transfer apparatus, for creating a curved flow trajectory between the boundary wall and the downstream wall;

a first heat source external to and in thermal communication with the boundary wall and the downstream wall; and a working fluid comprising a first fluid component with a second fluid component entrained therein, wherein the neck portion is shaped such that at least a portion of the second fluid component impinges upon at least a portion of the boundary wall and the downstream wall as the working fluid flows therethrough, whereby heat is transferred from the first heat source to the working fluid through the boundary wall and the downstream wall, and whereby the second fluid component changes phase from a gas to a liquid upon entering at least one of the first flow path or the curved flow trajectory and from a liquid to a gas upon impinging on the boundary wall and the downstream wall.

2. The apparatus of claim 1, wherein the boundary wall comprises a first wall portion defining a venturi.

3. The apparatus of claim 2, wherein the venturi comprises a curved central axis.

4. The apparatus of claim 1, wherein the neck portion has a diffuser section, the downstream wall being located within the diffuser section.

5. The apparatus of claim 1, wherein the downstream wall comprises a leading edge extending upstream towards the apex of the neck portion.

6. The apparatus of claim 1, wherein at least a portion of the downstream wall exhibits a high thermal conductivity.

7. The apparatus of claim 1, wherein the second fluid component comprises at least one of a liquid, a vapor, or a solid.

8. The apparatus of claim 7, wherein the second fluid component comprises water.

9. The apparatus of claim 1, wherein the first fluid component comprises air.

10. The apparatus of claim 1, wherein the first fluid component comprises a noble gas.

11. The apparatus of claim 1, further comprising a drive system for driving the working fluid through the neck portion.

12. The apparatus of claim 1, wherein the first heat source comprises means defining a second flow path external to the boundary wall.

13. The apparatus of claim 1, wherein the second flow path is substantially perpendicular to the first flow path through the neck portion.

14. The apparatus of claim 1, further comprising means defining a return flow path to transport a fluid passing from an exit of the neck portion back to an entrance of the neck portion.

15. The apparatus of claim 14, wherein the first flow path and return flow path define a closed loop.

16. The apparatus of claim 14, wherein the return flow path comprises a heat exchanger.

17. The apparatus of claim 16, wherein the heat exchanger removes heat from the working fluid.

18. The apparatus of claim 1, wherein the first flow path comprises an open loop.

19. The apparatus of claim 1, further comprising a fluid injection system upstream of the neck portion.

20. The apparatus of claim 19, wherein the fluid injection system injects the second fluid component into the first fluid component.

21. A method of transferring heat using a heat transfer apparatus, the method comprising:

providing a flow path having a neck portion defined by at least one boundary wall;

providing at least one downstream wall, located in an outlet portion of the heat transfer apparatus, for creating a curved flow trajectory between the boundary wall and the downstream wall;

providing a first heat source external to and in thermal communication with of the boundary wall and the downstream wall; and driving working fluid comprising a first fluid component with a second fluid component entrained therein through the neck portion such that at least a portion of the second fluid component impinges upon at least a portion of the boundary wall and the downstream wall as the working fluid flows therethrough, whereby heat is transferred from the first heat source to the first fluid component through the boundary wall and the downstream wall and whereby the second fluid component changes phase from a gas to a liquid upon entering at least one of the flow path or the curved flow trajectory and from a liquid to a gas upon impinging on of the boundary wall and the downstream wall.

22. The method of claim 21, wherein the second fluid component is denser than the first fluid component and the working fluid, prior to encountering the neck portion, comprises a cold core radially surrounded by a boundary layer exhibiting a low heat conduction, wherein at least a portion of the second fluid component is in thermal equilibrium with the cold core.

23. The method of claim 22, wherein, when the working fluid encounters the neck portion, at least a portion of the second fluid in thermal equilibrium with the cold core passes through the boundary layer and out of thermal equilibrium to absorb heat from the first heat source.

24. The method of claim 21, wherein the boundary wall comprises a first wall portion defining a venturi.

25. The method of claim 24, wherein the venturi comprises a curved central axis.

26. The method of claim 21, wherein the downstream wall is located within a diffuser section of the neck portion.

27. The method of claim 21, wherein the downstream wall comprises a leading edge extending upstream towards the apex of the neck portion.

28. The method of claim 21, wherein at least a portion of the downstream wall exhibits a high thermal conductivity.

29. The method of claim 21, wherein the second fluid component comprises at least one of a liquid or a vapor.

30. The method of claim 22, wherein the second fluid component comprises water.

31. The method of claim 21, wherein the first fluid component comprises air.

32. The method of claim 21, wherein the first fluid component comprises at least one noble gas.

33. The method of claim 21, wherein the first heat source comprises a second flow path external to the boundary wall.

34. The method of claim 21, wherein the second flow path is substantially perpendicular to the first flow path through the neck portion.

35. The method of claim 21, further comprising transporting a fluid passing from an exit of the neck portion back to an entrance of the neck portion over a return flow path.

36. The method of claim 35, wherein the first flow path and the return flow path define a closed loop.

37. The method of claim 35, wherein heat is removed by a heat exchanger in thermal communication with the return flow path.

38. The method of claim 21, wherein the first flow path comprises an open loop.

39. The method of claim 38, further comprising injecting the second fluid component into the first fluid component.

40. A heat transfer apparatus, comprising:

at least one boundary wall defining a curved flow path;

at least one downstream wall, located in an outlet portion of the heat transfer apparatus, for creating a curved flow trajectory between the boundary wall and the downstream wall;

a first heat source external to and in thermal communication with the boundary wall and the downstream wall; and a working fluid comprising a first fluid component with a second fluid component entrained therein, wherein at least one of the curved flow path or the curved flow trajectory is shaped such that at least a portion of the second fluid component impinges upon at least a portion of the boundary wall and the downstream wall as the working fluid flows therethrough, whereby heat is transferred from the first heat source to the working fluid through the boundary wall and the downstream wall and whereby the second fluid component changes phase from a gas to a liquid upon entering at least one of the flow path or the curved flow trajectories and from a liquid to a gas upon impinging on the boundary wall and the downstream wall.

41. The apparatus of claim 40, wherein the density of the second fluid component is larger than the density of the first fluid component.

42. The apparatus of claim 41, wherein the second fluid component comprises a plurality of particles having sufficient density that they do not follow the curvature of the first flow path when flowing therethrough.

43. The apparatus of claim 41, wherein the second fluid component is in thermal equilibrium with a core flow portion of the first fluid component prior to entering the curved flow path.

44. The apparatus of claim 40, further comprising a fluid injection system upstream of the curved flow path.

45. The apparatus of claim 44, wherein the fluid injection system injects the second fluid component into a core flow portion of the first fluid component.

46. The apparatus of claim 40, wherein a temperature of a core section of the working fluid is lower than a temperature of at least a portion of the boundary wall of the curved flow path as the working fluid passes along the curved flow path.

* * * * *